US012227996B2

(12) United States Patent
Evrard et al.

(10) Patent No.: US 12,227,996 B2
(45) Date of Patent: Feb. 18, 2025

(54) SNAP LATCH OR COLLET PROFILE

(71) Applicant: Schlumberger Technology Corporation, Sugar Land, TX (US)

(72) Inventors: Thomas Evrard, Clamart (FR); Steve Wattelle, Clamart (FR); Travis Hohenberger, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/718,716

(22) PCT Filed: May 17, 2023

(86) PCT No.: PCT/US2023/022499
§ 371 (c)(1),
(2) Date: Jun. 11, 2024

(87) PCT Pub. No.: WO2023/225058
PCT Pub. Date: Nov. 23, 2023

(65) Prior Publication Data

US 2024/0418045 A1 Dec. 19, 2024

Related U.S. Application Data

(60) Provisional application No. 63/364,852, filed on May 17, 2022.

(51) Int. Cl.
*E21B 17/046* (2006.01)
*E21B 17/042* (2006.01)

(52) U.S. Cl.
CPC ..... *E21B 17/046* (2013.01); *E21B 17/042* (2013.01)

(58) Field of Classification Search
CPC .... E21B 17/046; E21B 17/0465; E21B 17/06; E21B 17/04
See application file for complete search history.

(56) References Cited

U.S. PATENT DOCUMENTS 4,364,587 A * 12/1982 Samford ..... E21B 17/02 285/85
4,411,455 A * 10/1983 Schnatzmeyer ..... F16L 37/084 285/39
7,757,773 B2 7/2010 Rytlewski
2004/0149449 A1* 8/2004 Morrison ..... E21B 33/068 166/380

(Continued)

FOREIGN PATENT DOCUMENTS

WO 2021097017 A1 5/2021

OTHER PUBLICATIONS

Search Report and Written Opinion of International Patent Application No. PCT/US2023022499 dated Sep. 7, 2023, 8 pages.

*Primary Examiner* — David Carroll
(74) *Attorney, Agent, or Firm* — Jeffrey D. Frantz

(57) ABSTRACT

A snap latch or collet for connecting two components together is provided. In one embodiment a latch for connecting a first wellbore element and a second wellbore element includes multiple tensile fingers and multiple collet fingers. The multiple collet fingers include at least two collet fingers disposed circumferentially between a pair of circumferentially neighboring tensile fingers. Additional systems, devices, and methods are also disclosed.

14 Claims, 5 Drawing Sheets

(56) References Cited

U.S. PATENT DOCUMENTS

| | | | | |
|---|---|---|---|---|
| 2009/0056947 | A1* | 3/2009 | Du | H01R 13/533<br>439/255 |
| 2011/0094753 | A1* | 4/2011 | Whiddon | E21B 17/06<br>166/207 |
| 2014/0196889 | A1 | 7/2014 | Oberg | |
| 2016/0273290 | A1* | 9/2016 | Harms | E21B 17/046 |
| 2017/0254175 | A1* | 9/2017 | Provost | E21B 34/14 |
| 2020/0024912 | A1* | 1/2020 | Henderson | E21B 47/09 |

* cited by examiner

SNAP LATCH OR COLLET PROFILE

CROSS-REFERENCE TO RELATED APPLICATIONS

This application is the National Stage Entry of International Application No. PCT/US2023/022499, filed May 17, 2023, which claims benefit of U.S. Provisional Patent Application No. 63/364,852 filed May 17, 2022, which is incorporated by reference herein in its entirety.

BACKGROUND

Field

The present disclosure generally relates to a snap latch or collet profile and more particularly, in some instances, to a snap latch or collet profile to maximize load capacity through critical cross-sections.

Description of the Related Art

Latch or collet assemblies are often used in wellbore operations so that one member may be stabbed into another member for connection and later disconnected. For example, a snap latch can be used to interconnect two components disposed in a wellbore. To connect the components, a first amount of weight is applied to the latch. For disconnection, a second amount of weight in tension is applied to disconnect the connection.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

In one embodiment, a latch for connecting a first wellbore element and a second wellbore element includes multiple tensile fingers and multiple collet fingers. The multiple collet fingers include at least two collet fingers disposed circumferentially between a pair of circumferentially neighboring tensile fingers.

In another embodiment, an apparatus includes a first wellbore component connected to a second wellbore component by a latch. The latch includes a collet body having an upper portion and a lower portion. A tensile web includes tensile fingers that join the upper portion of the collet body to the lower portion of the collet body. Collet fingers are arranged between the tensile fingers, which include a first tensile finger and a second tensile finger. The collet fingers include a first collet finger and a second collet finger located alongside one another between the first tensile finger and the second tensile finger.

In a further embodiment, a method includes aligning a first wellbore component with a second wellbore component. The method also includes connecting the first and second wellbore components together with a latch having multiple tensile fingers and multiple collet fingers. The multiple collet fingers include at least two collet fingers disposed circumferentially between a pair of circumferentially neighboring tensile fingers. Connecting the first wellbore component to the second wellbore component includes stabbing the first wellbore component to the second wellbore component via the latch such that the multiple collet fingers engage an opposing surface of the first or second wellbore component.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

Certain embodiments, features, aspects, and advantages of the disclosure will hereafter be described with reference to the accompanying drawings, wherein like reference numerals denote like elements. It should be understood that the accompanying figures illustrate the various implementations described herein and are not meant to limit the scope of various technologies described herein.

DETAILED DESCRIPTION OF SPECIFIC EMBODIMENTS

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. However, it will be understood by those of ordinary skill in the art that the system and/or methodology may be practiced without these details and that numerous variations or modifications from the described embodiments are possible. This description is not to be taken in a limiting sense, but rather made merely for the purpose of describing general principles of the implementations. The scope of the described implementations should be ascertained with reference to the issued claims.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point at the surface from which drilling operations are initiated as being the top point and the total depth being the lowest point, wherein the well (e.g., wellbore, borehole) is vertical, horizontal or slanted relative to the surface.

Figure 1B:
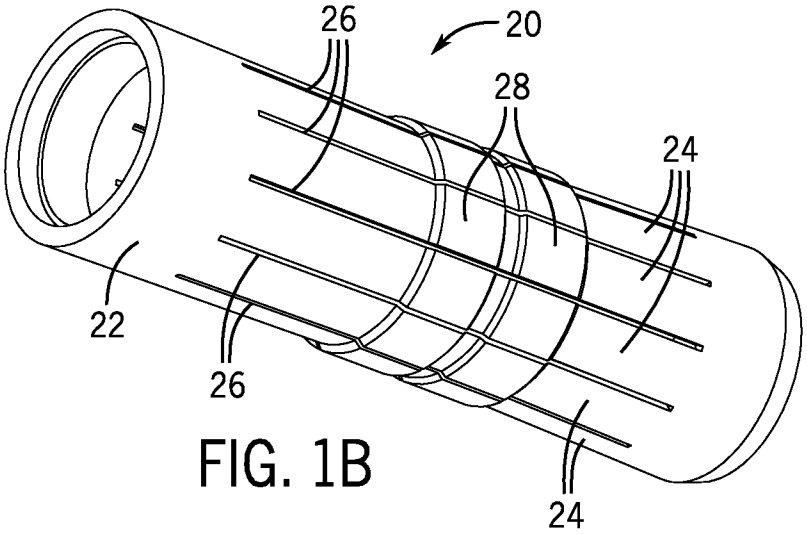
FIGS. 1A-1D illustrate certain latch designs.
Figure 1D:
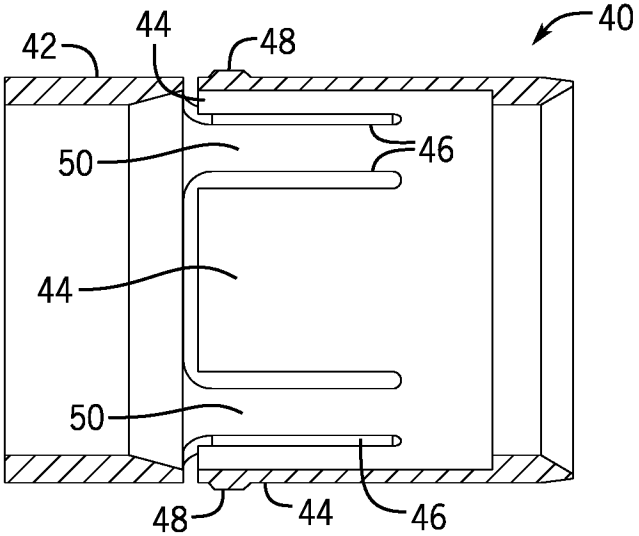
Figure 1A:
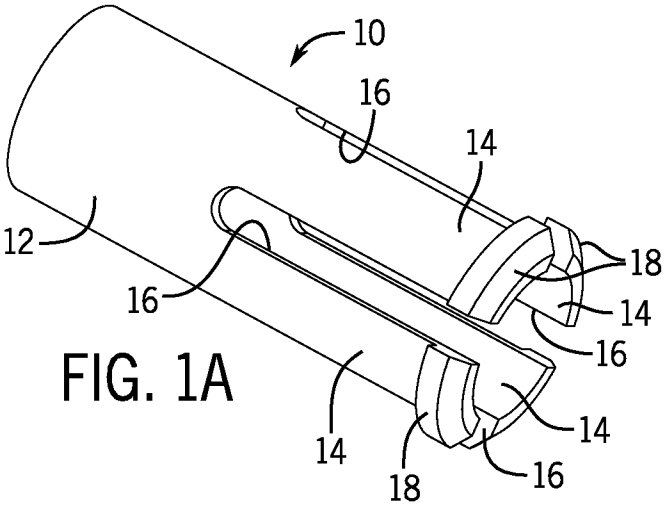
Figure 1C:
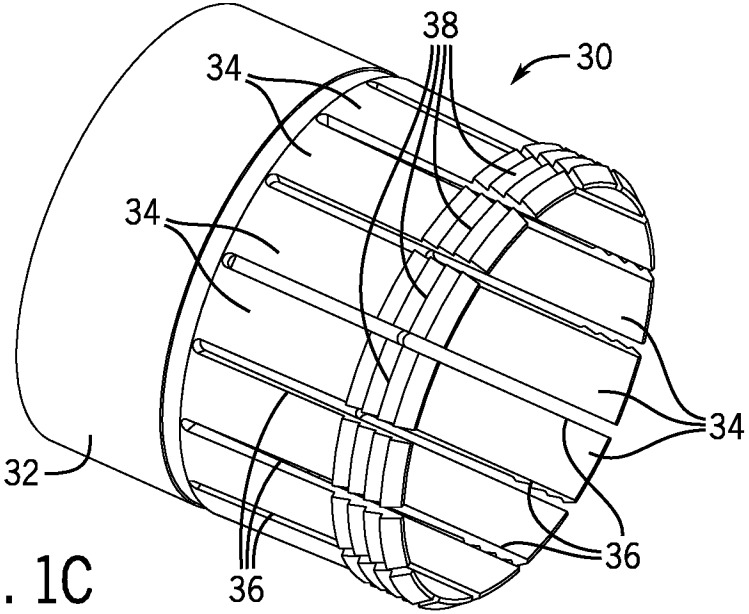

Snap latches or collet mechanisms can be used in oil and gas completions to connect various components and/or convey various types of systems downhole. Latches of various shapes are shown in FIGS. 1A-1D. FIG. 1A shows a single-ended collet 10 with one end supported. That is, the collet 10 includes a main body 12 that supports one end of each collet finger 14. Axial slots 16 separate the collet fingers 14, which include distal ends having radial protrusions 18 for locking engagement with a mating surface. FIG. 1B shows a double-ended collet 20 with two ends supported (i.e., a main body 22 supports opposite ends of each collet finger 24). Slots 26 extend between the collet fingers 24, which include radial protrusions 28 (e.g., circumferential ridges segmented by the slots 26) for locking engagement with a mating surface (e.g., mating grooves). FIG. 1C shows a snap latch 30 (which may also be called an anchor latch) having collet fingers 34 extending axially from a main body 32. The collet fingers 34 are separated by slots 36 and have free ends with threaded portions 38 for engaging a mating threaded surface. FIG. 1D shows a single-ended collet 40, which includes a main body 42 with tensile fingers 50 (which may collectively be referred to as a tensile web) between collet fingers 44. The tensile fingers 50 join opposing end portions of the main body 42. The collet fingers 44 extend axially from one end of the main body 42 but are separated from the other end of the main body 42, and from the tensile fingers 50, by slots 46. Radial protrusions 48 on the collet fingers 44 facilitate locking engagement with a mating surface.

In the examples of FIGS. 1A-1D, the collet fingers 14, 24, 34, and 44 can elastically deform to facilitate connection and disconnection of the latch. The collet fingers 14, 24, 34, and 44 are adapted to support an axial load through engagement of these collet fingers with mating features (e.g., grooves, recesses, or shoulders) of connected components. If the axial load exceeds the load capacity of the collet fingers, the collet fingers can elastically deform (e.g., inwardly) to release the latch from a connected component. Additional details regarding latches, as well as their use in running equipment into a wellbore, can be found in U.S. Pat. No. 7,757,773, the entirety of which is hereby incorporated by reference herein.

Figure 2:
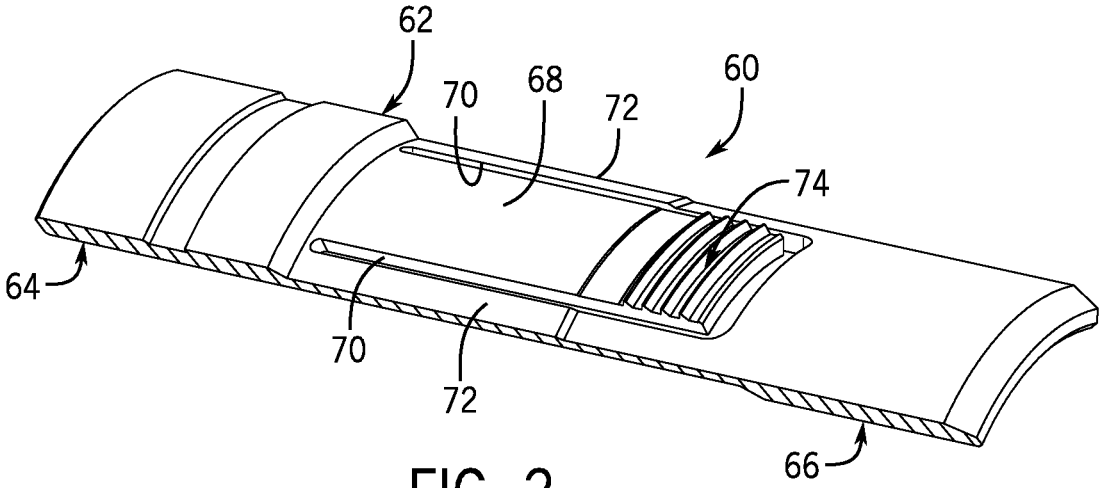
FIG. 2 illustrates a section of an example latch design showing a collet finger with a threaded end for engaging a mating profile of an opposing member.

Latches can be designed to balance cross-sectional areas between the collet fingers and tensile fingers, for example as shown in FIG. 2 (which illustrates a 60° symmetric section of a latch 60). The latch 60 includes a main body 62 having an upper end portion 64 and a lower end portion 66 joined by a tensile web of tensile fingers 72. As depicted, a collet finger 68 is disposed circumferentially between two neighboring tensile fingers 72. Although only a 60° section of the latch 60 is shown in FIG. 2, it will be appreciated that the full latch 60 can have six tensile fingers 72 and six collet fingers 68, with a single collet finger 68 positioned between each pair of neighboring tensile fingers 72. Slots 70 separate the tensile fingers 72 from the collet fingers 68, which may include a threaded portion 74 to facilitate engagement with a mating threaded portion of a connected component. In some instances, the latch 60 can be used to connect an upper string of a wellbore assembly to a lower string (e.g., an upper completion to a lower completion). The tensile fingers 72 transmit axial force to components connected below the upper string of the wellbore assembly via the lower end portion 66 of the main body 62. With one or more such components connected below the upper string of the wellbore assembly via the lower end portion 66, the tensile fingers 72 carry a tail weight (e.g., 30,000 lbf in the example illustrated in FIG. 2) during pull out of hole. It will be appreciated that the tensile web (and tensile fingers 72) can be used to transmit not only a tensile axial force but also a compressive axial force; as such, the tensile web (with tensile fingers 72) may also be considered to be a compressive web (with compressive fingers 72).

Narrow fingers may be preferred in latches in some instances, as narrow fingers can reduce shear deformations, enhance repeatability in the shifting force, and impose less damage to contact surfaces due to an edge-rounding effect that occurs during engagement or disengagement. However, narrow fingers generally require milling (or other removal or absence) of material that would otherwise be available to carry tensile loads or bearing/shear loads at the latch profile interface. This problem worsens as the number of fingers increases and has a detrimental effect on the load capacity of the tensile web between collet fingers.

Figure 3:
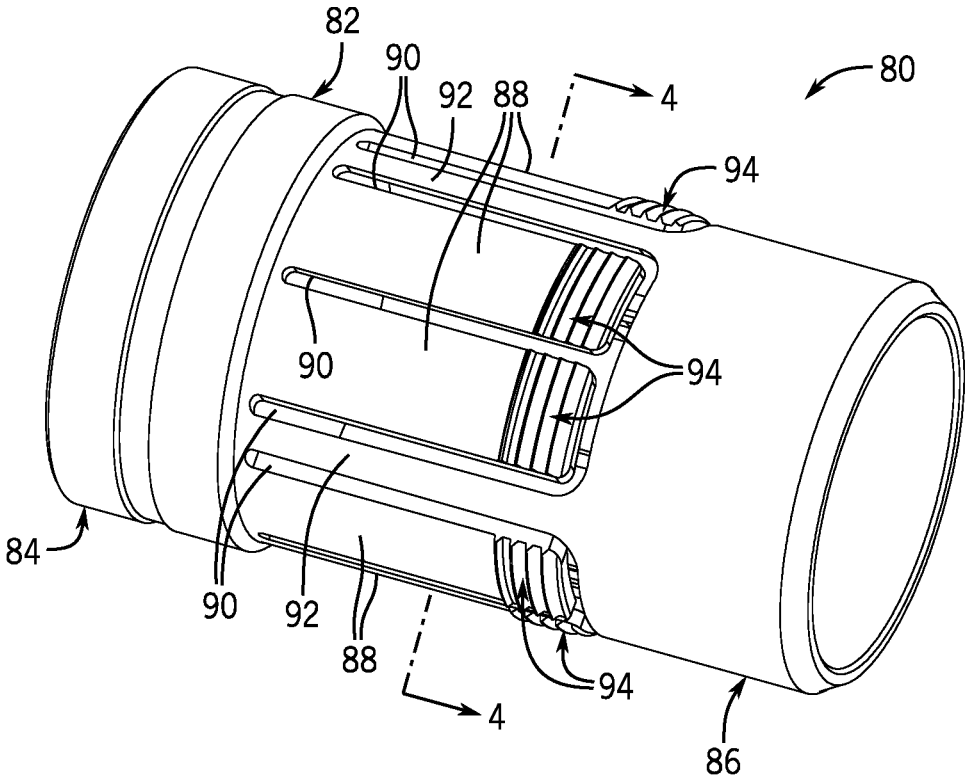
FIG. 3 illustrates a perspective view of an example latch design with collet fingers and tensile fingers circumferentially disposed about the latch body in accordance with one embodiment of the present disclosure.

Some embodiments of the present disclosure include snap latch collet designs with collet fingers and a tensile web. Latches according to the present disclosure may advantageously reduce stress within the different finger sections, specifically the collet fingers and tensile web between the collet fingers. FIG. 3 illustrates an example snap latch collet for connecting two components (e.g., a first wellbore component and a second wellbore component) according to one embodiment of the present disclosure. The depicted latch 80 includes a main body 82 having an upper end portion 84 and a lower end portion 86 joined by a tensile web (i.e., tensile fingers 92). As noted above, the tensile web with tensile fingers 92 can be used to transmit a compressive axial force and, thus, may also be considered a compressive web with compressive fingers 92. Further, the latch 80 of FIG. 3 includes a pair of collet fingers 88 positioned together between each neighboring pair of tensile fingers 92, rather than a tensile finger 92 positioned between each neighboring pair of collet fingers. The collet fingers 88 are shown extending axially from the upper end portion 84 and having a free distal end spaced apart from the lower end portion 86. But in other instances, the orientation of the collet fingers 88 can be reversed, with the collet fingers 88 extending from the lower end portion 86 and ending before reaching the upper end portion 84. The collet fingers 88 include threaded portions 94 for engaging a mating threaded surface of a connected component, such that loading from the connected component may be carried by the latch through the threaded interface. Slots 90 separate the collet fingers 88 and the tensile fingers 92.

Figure 4:
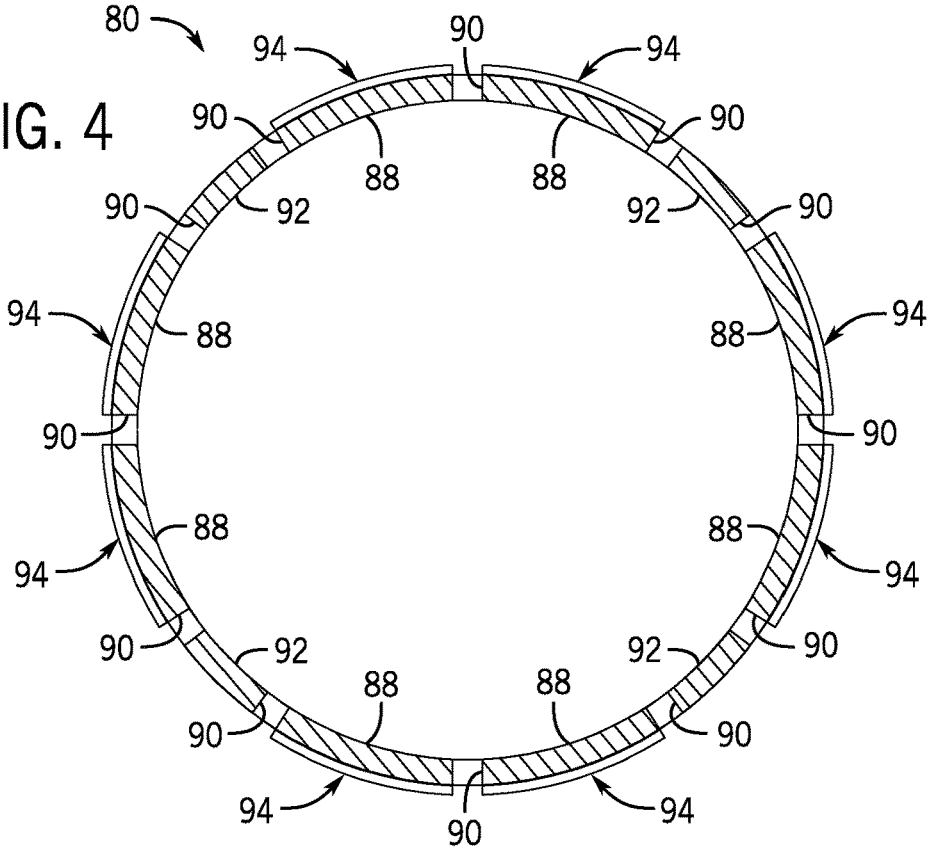
FIG. 4 is an axial cross-section of the latch of FIG. 3 and shows eight collet fingers and four tensile fingers, with two collet fingers disposed circumferentially between each pair of circumferentially neighboring tensile fingers, in accordance with one embodiment.

As illustrated in FIGS. 3 and 4, the latch 80 is a collet latch with eight collet fingers 88 and four tensile fingers 92, in which a pair of collet fingers 88 is disposed circumferentially between each pair of circumferentially neighboring tensile fingers 92. The illustrated design advantageously reduces the material lost to slots 90, thereby increasing the load capacity of the tensile web.

Figure 5:
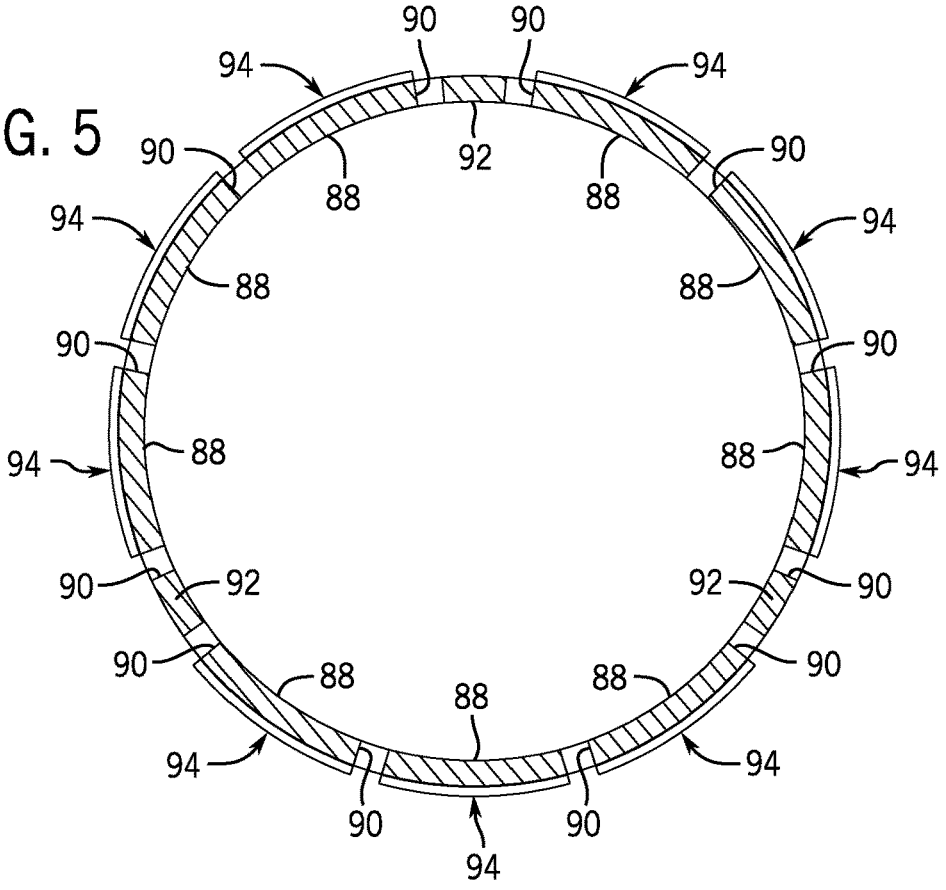
FIG. 5 is an axial cross-section similar to that of FIG. 4 but depicts a latch having nine collet fingers and three tensile fingers, with three collet fingers disposed circumferentially between each pair of circumferentially neighboring tensile fingers, in accordance with one embodiment.
Figure 6:
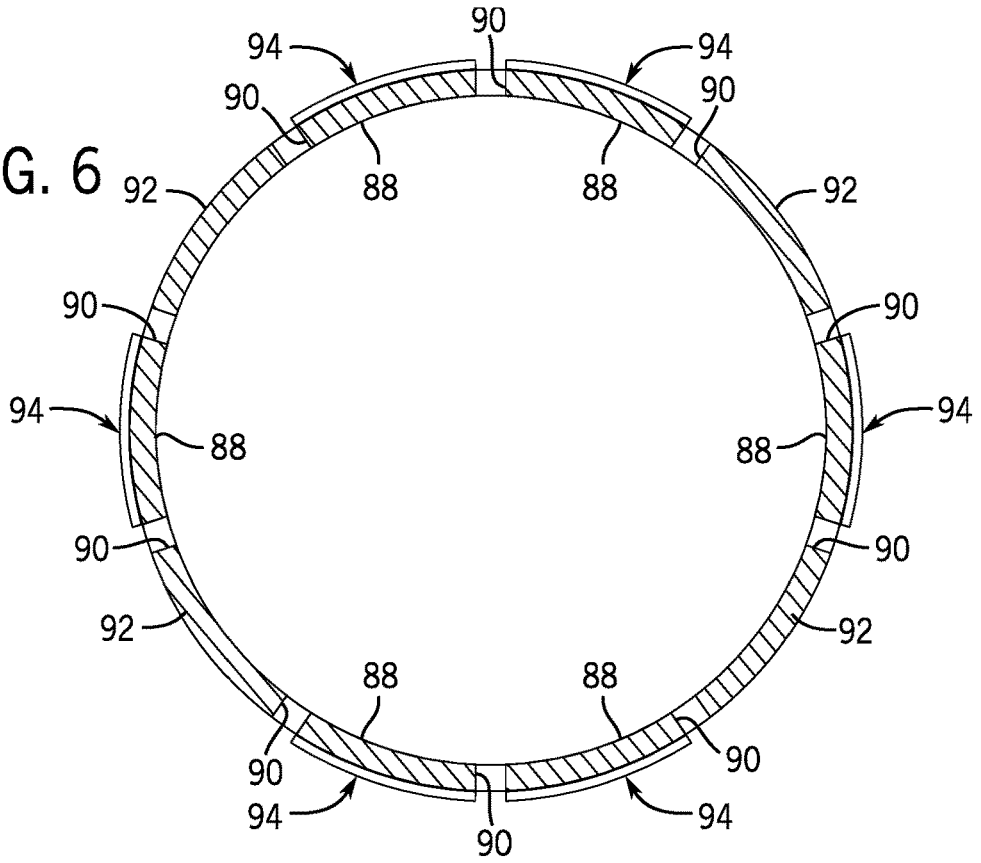
FIG. 6 is an axial cross-section similar to that of FIGS. 4 and 5 but depicts a latch having six collet fingers and four tensile fingers, with the six collet fingers distributed unequally between the four tensile fingers, in accordance with one embodiment.

In other configurations, any number of collet fingers 88 can be disposed between tensile fingers 92 to suitably balance cross-sectional areas of the tensile web and collet fingers 88. In FIG. 5, for example, the latch 80 is depicted with nine collet fingers 88 and three tensile fingers 92, with three of these collet fingers 88 disposed circumferentially between each pair of tensile fingers 92. Rather than having an equal number of collet fingers 88 positioned between each circumferentially neighboring pair of tensile fingers 92, the collet fingers 88 are not distributed equally between the circumferentially neighboring tensile fingers 92 in some other instances. In one embodiment depicted in FIG. 6, for instance, the latch 80 includes six collet fingers 88 and four tensile fingers 92. Two collet fingers 88 are disposed circumferentially between some neighboring pairs of tensile fingers 92, while one collet finger 88 is disposed circumferentially between other neighboring pairs of tensile fingers 92. In addition to varying the number of collet fingers 88 and tensile fingers 92, the widths of the collet fingers 88, the tensile fingers 92, and the slots 90 may be varied between different embodiments (e.g., based on desired load capacity of the collet fingers 88 and the desired load capacity of the tensile fingers 92). The lengths, thicknesses, and shapes of the slots 90 and of the fingers 88 and 92 may also be varied.

Figure 7:
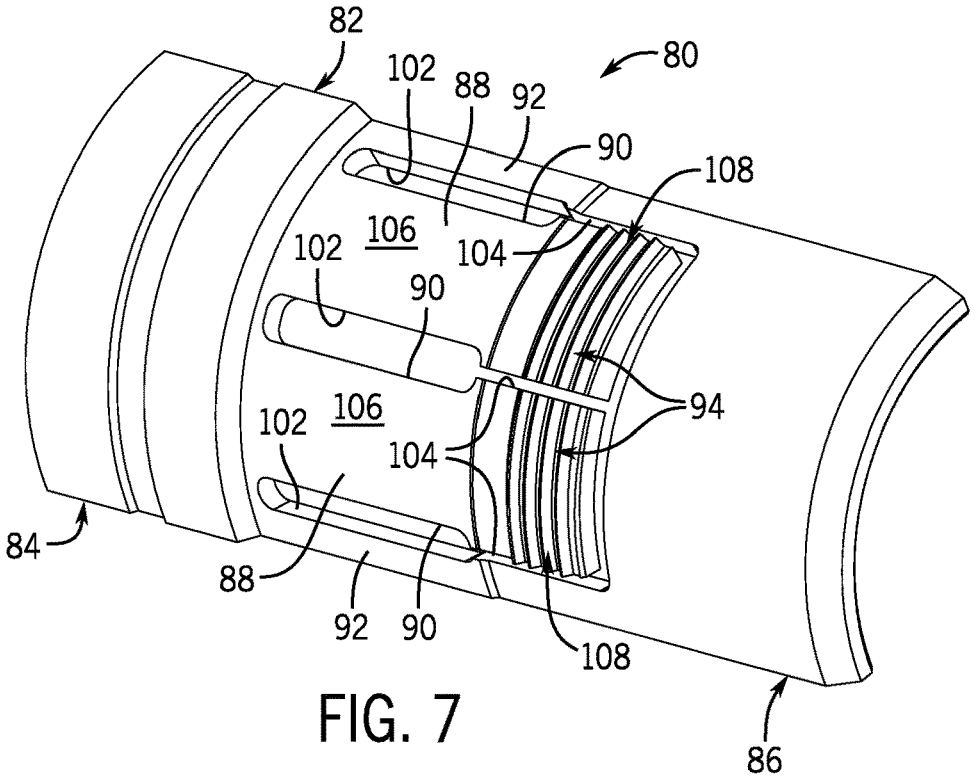
FIG. 7 illustrates a partial view of another example latch design in accordance with one embodiment.

For manufacturing, it is often preferable to use a mill diameter with sufficient rigidity to quickly machine slots. FIG. 7 illustrates a partial view of another example latch 80 according to one embodiment, in which an increased mill diameter has been used to manufacture the latch compared to the configuration of FIG. 3. For example, a mill diameter of about 0.25" could be used to form the slots 90 between neighboring fingers in the latch of FIG. 3, whereas a 0.375" mill diameter could be used for the outer two illustrated slots 90 in FIG. 7 (i.e., slots that separate a tensile finger 92 from a collet finger 88) and a 0.500" mill diameter for the middle slot 90 in FIG. 7 (i.e., the slot that separates the two collet fingers 88). However, a wider mill removes more material. If the wider slots extended to areas circumferentially between the latch threaded portions 94, more material would be removed from the latch thread, which may be a critically loaded feature. To increase or maximize the thread bearing area of the collet fingers 88, a 0.125" mill or saw can be used to complete the finger cuts, e.g., circumferentially between the threaded portions 94. This technique advantageously preserves the tensile web area and the bearing area of the threads.

By way of example, FIG. 7 depicts the slots 90 as having wider slot portions 102 extending axially along base portions 106 of the collet fingers 88 and narrower slot portions 104 extending axially along distal end portions 108 of the collet fingers 88. For a given axial location along the latch 80 at which the wider slot portions 102 are positioned, in some instances the width of the slot 90 between the collet fingers 88 is greater than that of each of the slots 90 between one of the collet fingers 88 and one of the tensile fingers 92. As also shown in FIG. 7, the collet fingers 88 are wider across the distal end portions 108 than across the base portions 106 in some embodiments.

Figure 8:
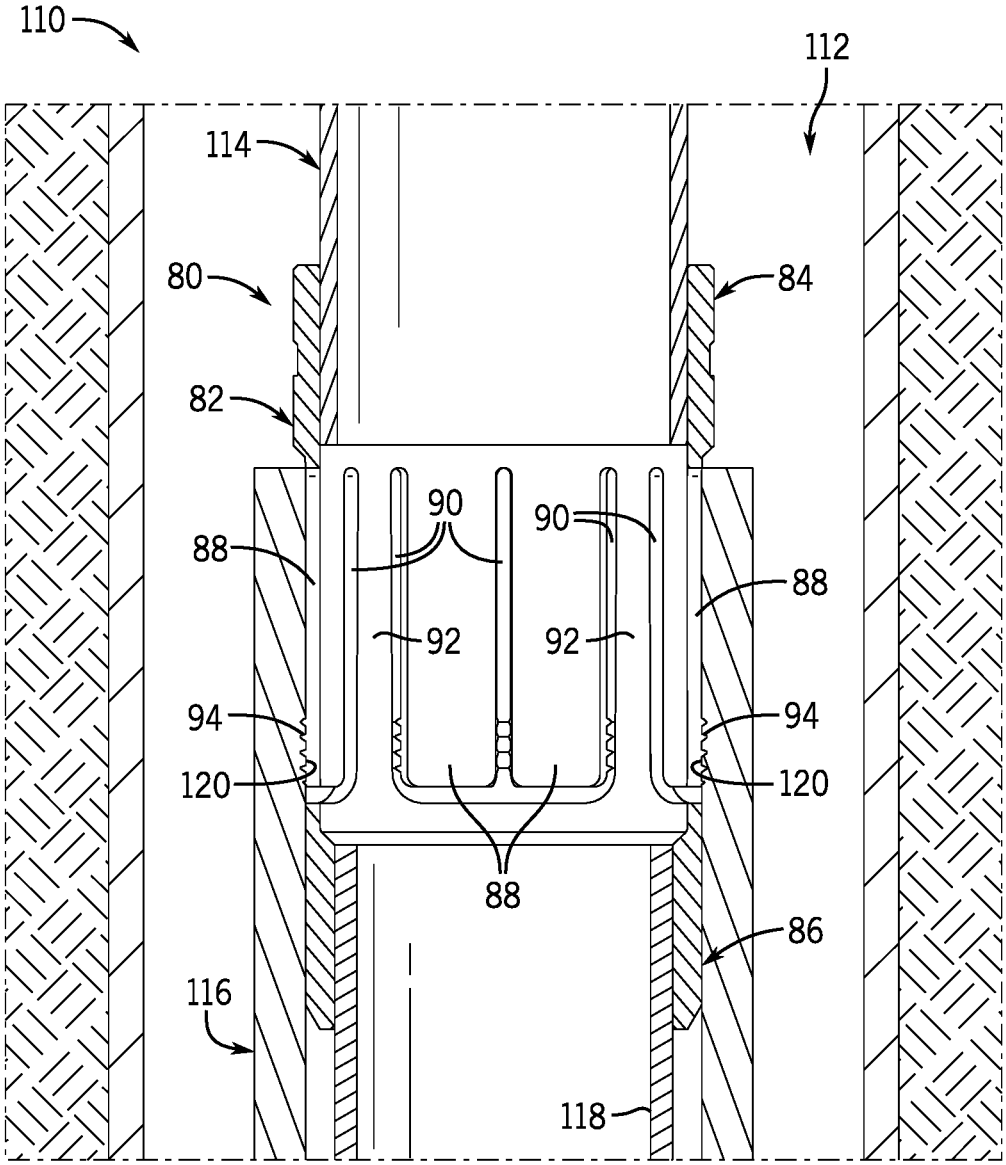
FIG. 8 depicts a first wellbore component connected to a second wellbore component via a latch in accordance with one embodiment.

In one embodiment depicted in FIG. 8, an apparatus 110 includes a first wellbore component 114 connected to a second wellbore component 116 in a well 112 by a latch 80 (e.g., the eight-collet-fingered latch of FIG. 3). In at least some instances, the first wellbore component 114 is an upper completion and the second wellbore component 116 is a lower completion. An additional component 118 (e.g., a lower string suspended from the bottom of the latch 80) is connected to the first wellbore component 114 via the latch 80 such that the additional component 118 applies a tensile load to the tensile fingers 92 of the latch 80 within the well 112. In other instances, the additional component 118 is omitted and no additional tail weight is carried by the tensile fingers 92. In at least some instances, the first wellbore component 114 is aligned with and then stabbed to the second wellbore component 116 such that the threaded portions 94 of the collet fingers 88 engage a mating threaded portion 120 of the second wellbore component 116. The first and second wellbore components 114 and 116 can be lowered into the well 112, such as generally shown in FIG. 8. An axial tension load can be applied to the latch to disconnect the first wellbore component 114 from the second wellbore component 116 within the well 112 (e.g., by causing the collet fingers 88 to elastically deform and release from the second wellbore component 116). In other instances, the latch 80 can be rotated to unthread the threaded portions 94 of the collet fingers 88 from the mating threaded portion 120 of the second wellbore component 116. A locking component, such as a locking sleeve moved behind the collet fingers 88 within the latch 80, could be used to selectively prevent deformation and release of the collet fingers 88 from the second wellbore component 116.

Latches described above may be used in the oil and gas industry to connect wellbore components together. In some instances, a latch described above can be used to facilitate running of equipment into a wellbore and may enable consolidation of multiple tasks into a single trip into the wellbore. But it will be appreciated that latches described herein may be used in other applications. A latch described above may be used for connecting components in deep sea mining, geothermal activities, or carbon capture efforts, for instance.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately," "about," "generally," and "substantially" may refer to an amount that is within less than 10% of, within less than 5% of, within less than 1% of, within less than 0.1% of, and/or within less than 0.01% of the stated amount. As another example, in certain embodiments, the terms "generally parallel" and "substantially parallel" or "generally perpendicular" and "substantially perpendicular" refer to a value, amount, or characteristic that departs from exactly parallel or perpendicular, respectively, by less than or equal to 15 degrees, 10 degrees, 5 degrees, 3 degrees, 1 degree, or 0.1 degree.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. It is also contemplated that various combinations or sub-combinations of the specific features and aspects of the embodiments described may be made and still fall within the scope of the disclosure. It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above.

What is claimed is:

1. A latch for connecting a first wellbore element and a second wellbore element, the latch comprising:

a plurality of tensile fingers; and a plurality of collet fingers, wherein the plurality of collet fingers includes at least two collet fingers disposed circumferentially between a pair of circumferentially neighboring tensile fingers.

2. The latch of claim 1, wherein the plurality of collet fingers includes at least two collet fingers disposed circumferentially between each pair of circumferentially neighboring tensile fingers.

3. The latch of claim 2, wherein the collet fingers are distributed equally between the circumferentially neighboring tensile fingers.

4. The latch of claim 3, wherein the latch is a collet latch with eight collet fingers and four tensile fingers, with two of the eight collet fingers disposed circumferentially between each pair of circumferentially neighboring tensile fingers.

5. The latch of claim 3, wherein the latch is a collet latch with nine collet fingers and three tensile fingers, with three of the nine collet fingers disposed circumferentially between each pair of circumferentially neighboring tensile fingers.

6. The latch of claim 2, wherein the collet fingers are not distributed equally between the circumferentially neighboring tensile fingers.

7. The latch of claim 1, wherein each collet finger of the plurality of collet fingers includes a threaded portion configured to engage a mating threaded surface.

8. The latch of claim 7, wherein the latch includes a main body with a first portion and a second portion that are connected together by the plurality of tensile fingers, each collet finger of the plurality of collet fingers includes a base portion extending lengthwise from the first portion of the main body, and each collet finger is wider across the threaded portion than across the base portion.

9. The latch of claim 8, wherein each collet finger extends from the first portion of the main body and terminates at a distal end that is spaced apart from the second portion of the main body.

10. The latch of claim 9, wherein the distal end includes the threaded portion.

11. The latch of claim 1, wherein a first slot separates a first tensile finger of the pair of circumferentially neighboring tensile fingers from a first collet finger of the at least two collet fingers, a second slot separates a second tensile finger of the pair of circumferentially neighboring tensile fingers from a second collet finger of the at least two collet fingers, a third slot separates the first collet finger from the second collet finger or from an additional collet finger of the at least two collet fingers, and the latch includes an axial location at which the width of the third slot is greater than that of the first slot and greater than that of the second slot.

12. A method comprising:

aligning a first wellbore component with a second wellbore component; and connecting the first wellbore component to the second wellbore component with a latch having a plurality of tensile fingers and a plurality of collet fingers, wherein the plurality of collet fingers includes at least two collet fingers disposed circumferentially between a pair of circumferentially neighboring tensile fingers, and connecting the first wellbore component to the second wellbore component includes stabbing the first wellbore component to the second wellbore component via the latch such that the plurality of collet fingers engage an opposing surface of the first or second wellbore component.

13. The method of claim 12, comprising lowering the first and second wellbore components connected with the latch into a well.

14. The method of claim 13, comprising applying an axial tension load to the latch to disconnect the first wellbore component from the second wellbore component within the well.

* * * * *